US006163986A

United States Patent [19]

Townsend

[11] Patent Number: 6,163,986

[45] Date of Patent: Dec. 26, 2000

[54] NON-MOTORIZED MACHINE FOR THROWING SNOW OR OTHER DEBRIS

[76] Inventor: Walter C. Townsend, 2716 N. 19th St., Milwaukee, Wis. 53206

[21] Appl. No.: 09/186,802

[22] Filed: Nov. 5, 1998

[51] Int. Cl.[7] ..... E01H 5/02

[52] U.S. Cl. ..... 37/265; 37/209; 37/230

[58] Field of Search ..... 37/196, 209, 222, 37/223, 230, 242, 265, 284, 285, 247, 260, 261

[56] References Cited

U.S. PATENT DOCUMENTS

| | | | |
|---|---|---|---|
| 283,415 | 8/1883 | Passmore | 15/79.1 |
| 328,633 | 10/1885 | Angell . | |
| 395,548 | 1/1889 | Corbett . | |
| 617,830 | 1/1899 | Herran . | |
| 712,315 | 10/1902 | Langworthy . | |
| 764,426 | 4/1904 | Ciralli . | |
| 769,189 | 9/1904 | Sibbald . | |
| 993,739 | 5/1911 | Vickers . | |
| 998,517 | 7/1911 | Humm | 15/79.2 |
| 1,235,536 | 7/1917 | Bradshaw | 15/83 |
| 2,171,075 | 8/1939 | Blazier | 15/79.2 |
| 2,307,412 | 1/1943 | Lewis . | |
| 2,768,453 | 10/1956 | Adams, Jr. | 37/252 |
| 2,768,454 | 10/1956 | Schmechel | 37/240 |
| 2,965,910 | 12/1960 | Van Ranst | 15/79 |
| 3,337,973 | 8/1967 | Presscott | 37/265 |
| 3,994,081 | 11/1976 | Middleton . | |
| 4,199,181 | 4/1980 | Mason . | |
| 4,253,257 | 3/1981 | Albert . | |
| 4,910,893 | 3/1990 | Asay | 37/281 |
| 5,161,318 | 11/1992 | Bergman et al. . | |

OTHER PUBLICATIONS

12–Snowbladz brocure, 13–Snowbladz brochure—Oct. 1989, 14 Yard–Man brochure—1996, 15–Troy–Bilt brochure—1996, 16—Troy–Bilt brochure—1996, 17–Walter Drake catalog p. 91—1997, 18–Harriet Carter catalog p. 71—1997, 19–Brookstone catalog p. 18—1996, 20–Hammacher Schlemmer catalog p.—1994.

*Primary Examiner*—Thomas B. Will
*Assistant Examiner*—Kristine M. Markovich
*Attorney, Agent, or Firm*—Ryan Kromholz & Manion, S.C.

[57] ABSTRACT

A manually operated machine, which requires minimal physical effort and does not produce harmful pollution, is provided for throwing snow or other debris. The machine includes a frame supported by at least one wheel that actuates at least one rotating blade or brush when the machine is pushed forward. A handle is provided to facilitate pushing the machine and a shroud is provided to help direct the snow or debris and shield the operator from misdirected material. A pivoting mechanism allows an operator to direct the thrown debris to either side by pivoting the blade or brush. An adjustment lever and a pivot lock are provided to facilitate the pivoting action.

4 Claims, 5 Drawing Sheets

20
38
28
21
30
60
40
50
22
52
32
34
35

60
4
64
86
82
84
23
62
26
38
21
29
25
24
27
4

40
122
50
42
120
23
26
29
38
25
24
27
112
108
102
104
110
106
100

NON-MOTORIZED MACHINE FOR THROWING SNOW OR OTHER DEBRIS

BACKGROUND OF THE INVENTION

The present invention relates generally to a machine for removing debris, and more specifically to a non-motorized, or manually operated, machine for throwing snow or other debris.

Throughout winter a household or business often encounters a need to remove snow from sidewalks or driveways. Although numerous devices are known in the art to provide snow removal, these devices tend to fall into two categories: (1) snow shovels, which require substantial physical effort, and (2) powered snow blowers and snow throwers, which are not only expensive but bulky and contribute to pollution. Other inventions have tried to fill the gap between these two extremes, but they too are either too labor intensive or work ineffectively. For example, some devices are little more than a push shovel with wheels. Another device positions a set of wheels so that a shovel becomes a lever that assists in lifting away unwanted snow. Although aided by the use of wheels, these devices still require great physical exertion to push and transport the snow.

Additional snow removal machines employ an auger to force the snow to one side. Even though such devices avoid lifting and throwing the snow, unless aided by a motor they still require extreme effort to move through the snow.

Although there are other mechanical snow removal machines that attempt to lift and deposit the snow to one side using a series of blades, brushes, or belts, these devices are bulky and difficult to manipulate.

Motorized snow blowers and snow throwers provide effective snow removal, but they also require fuel or electricity to operate, thus incurring additional expenses and contributing to environmental pollution. Motorized machines also require extensive maintenance for them to run properly. Furthermore, because motorized machines are bulky, they are neither efficient nor effective for small jobs.

Even though the present invention is ideal for removing snow, the invention can also be adapted to push away other types of debris such as dirt, trash, leaves, water, sawdust, gravel, or other similar material. Accordingly, the present invention's use should not be limited to the removal of snow.

For the foregoing reasons, there is a need for a machine that effectively removes snow or other debris with minimal physical effort and without the need for an engine or motor that requires fuel and thus produces harmful pollution.

SUMMARY

According to the present invention, the foregoing and other objects and advantages are attained by providing a non-motorized, or manually operated, machine comprising a throwing mechanism that includes at least one rotating blade or brush that throws the snow or debris forward. The blade is attached to a primary drive shaft that is rotatably coupled to a frame. The frame is supported by at least one wheel. The blade is mechanically connected to the support wheel such that as the support wheel turns, by pushing the machine forward, it actuates the throwing mechanism. A handle is provided to facilitate pushing the machine. A shroud is provided to help direct the snow or debris and shield the operator from misdirected material.

In accordance with another aspect of the invention, the throwing mechanism is pivotally supported such that the operator can pivot the throwing mechanism and thus control the direction in which the machine throws the snow or debris. An adjustment lever and a pivot lock are also provided for easy pivoting of the throwing mechanism and locking it in place.

In accordance with another aspect of the invention, the machine employs blades that can scoop away snow, slush, or other type of debris.

In accordance with another aspect of the invention, the machine employs bristles, which may form a brush, that can more easily wisp away light snow, dirt, or other type of debris.

A further advantage of the invention is a disengaging clutch that allows an operator to disengage the throwing mechanism during transport. An adjustment lever is also provided to allow easy manipulation of the clutch.

A further advantage of the invention is a ratcheting freewheel that transmits torque in only one direction, thus disengaging the throwing mechanism if the machine is moved in reverse.

The machine thus provides an easy to operate, environmentally friendly, labor saving way to remove snow or other debris.

DETAILED DESCRIPTION

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

Figure 1:
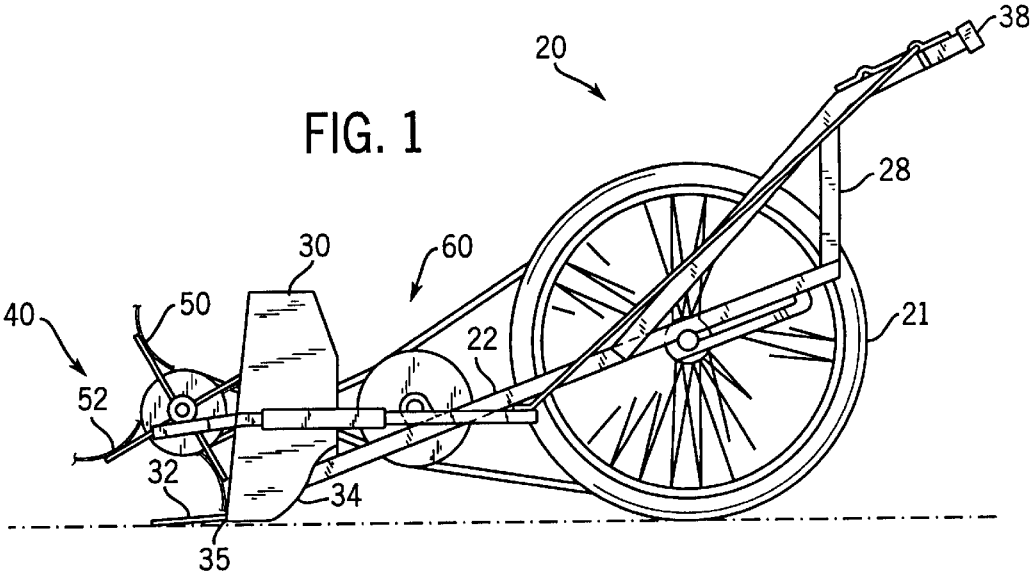
FIG. 1 is a side plan view of a preferred embodiment of a machine made in accordance with the teachings of the present invention.
Figure 2:
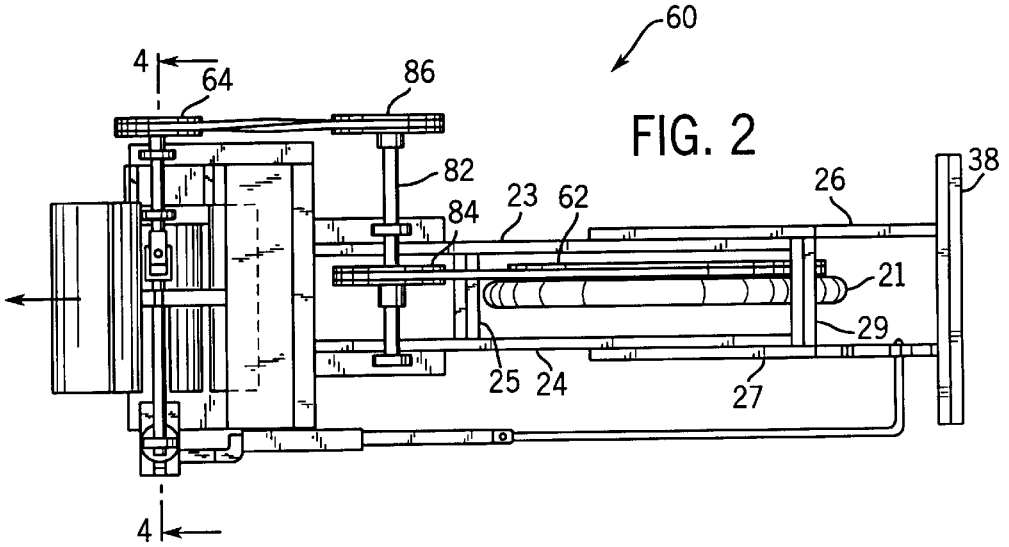
FIG. 2 is a top plan view of one embodiment of the machine.
Figure 3:
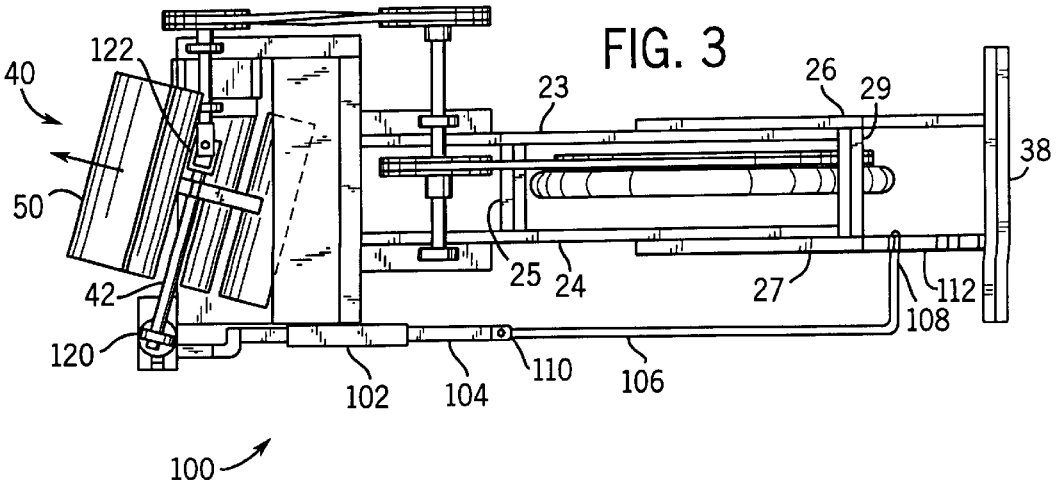
FIG. 3 is a top plan view of one embodiment of the machine, showing the throwing mechanism pivoted to throw debris to the operator's right.

The preferred embodiment of the present invention is illustrated in FIGS. 1, 2 and 3. As shown in FIG. 1, the device generally provides a supporting frame 22, a handle member 38, a support wheel 21, a shroud 30, a throwing mechanism 40, and drive mechanism 60.

FIGS. 2 and 3 show that in one embodiment the frame 22 includes two generally parallel rails 23 and 24 connected by a crosspiece 25. The frame 22 further includes two generally parallel rails 26 and 27 attached to rails 23 and 24 respectively to support the handle member 38. Additional support may be provided by connecting rails 26 and 27 by a crosspiece 29 and by providing a support rail 28 running between rail 23 and rail 26, and a support rail 28 running between rail 24 and rail 27. Although this configuration is the preferred embodiment, other frame 22 configurations will also provide adequate support.

The frame 22 can be made of any material sufficiently strong to withstand the pressures exerted upon it. Although steel is used in the preferred embodiment, aluminum, plastic, metal or plastic tubing, or wood may be used. Depending on the material used, the handle member 38 is attached to the supporting frame 22 using welding techniques, screws, cooperating nuts and bolts, or other methods commonly known in the art. To facilitate manual pushing of the machine, the handle member 38 should be ergonomically designed.

Although in the preferred embodiment one support wheel 21 is used, additional support wheels may be added to provide stability. The support wheel 21 can be of any functional size. While any wheel diameter between 12 and 48 inches is practical, a wheel diameter of 24 to 36 inches is preferred. A practical embodiment operated successfully using a conventional 26 inch diameter bicycle wheel. Not only does a large diameter support wheel 21 expedite moving the machine, but a large diameter support wheel 21 also allows a greater diameter drive wheel 62, which in turn enables the machine to rotate the drive mechanism 60 at a greater velocity. This action is explained later.

Figure 4:
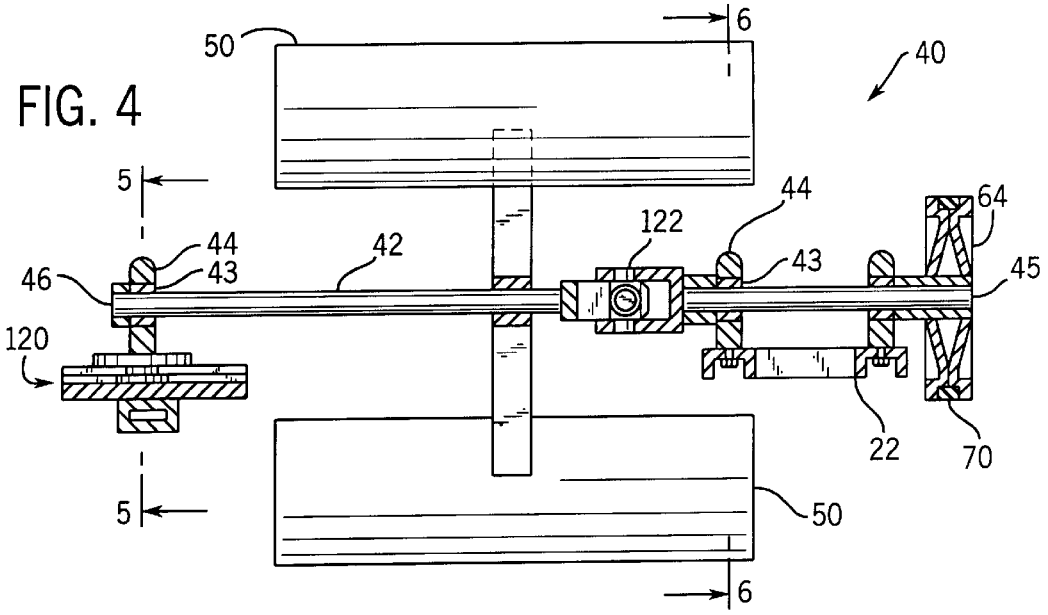
FIG. 4 is a cross sectional view of one embodiment of the throwing mechanism taken along lines 4—4 of FIG. 2.
Figure 5:
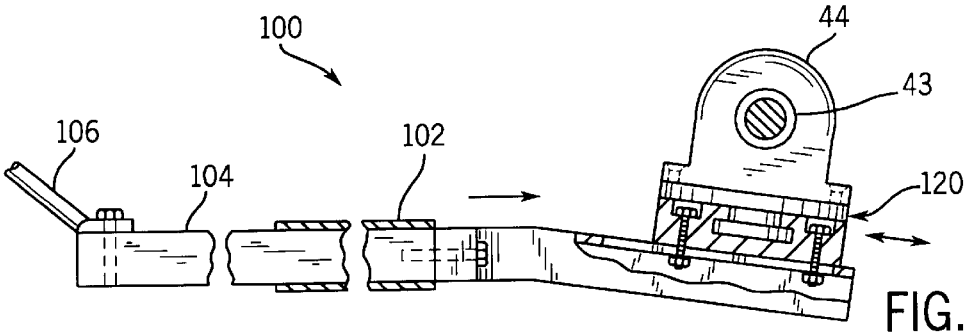
FIG. 5 is a fragmentary sectional view of a portion of one embodiment of the pivoting mechanism taken along lines 5—5 of FIG. 4.
Figure 6:
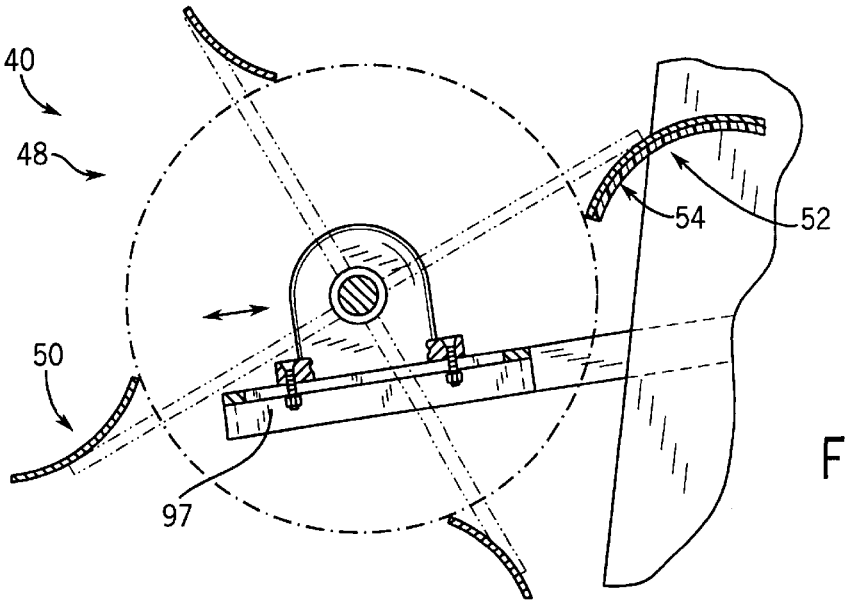
FIG. 6 is a cross sectional view of one embodiment of the throwing mechanism taken along lines 6—6 of FIG. 4.
Figure 7:
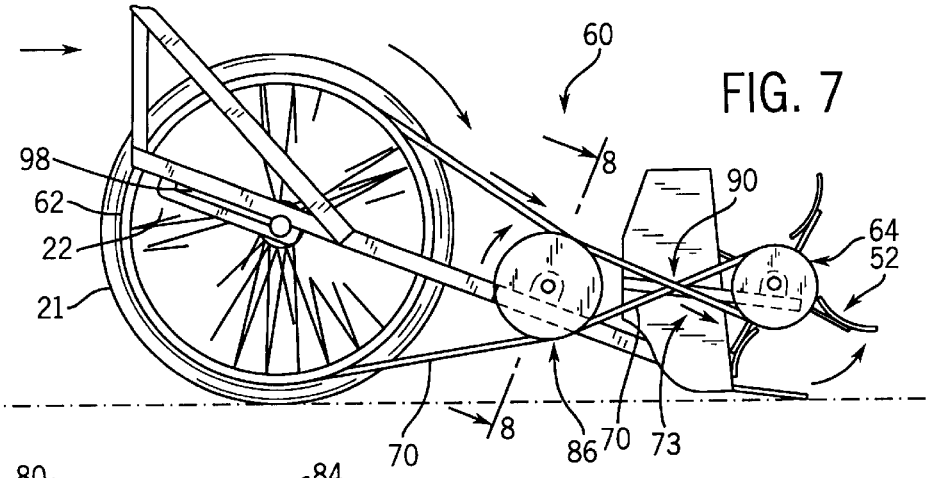
FIG. 7 is a partial side plan view showing the rotation of the wheels and belt pulleys included in one embodiment of the drive mechanism.
Figure 13:
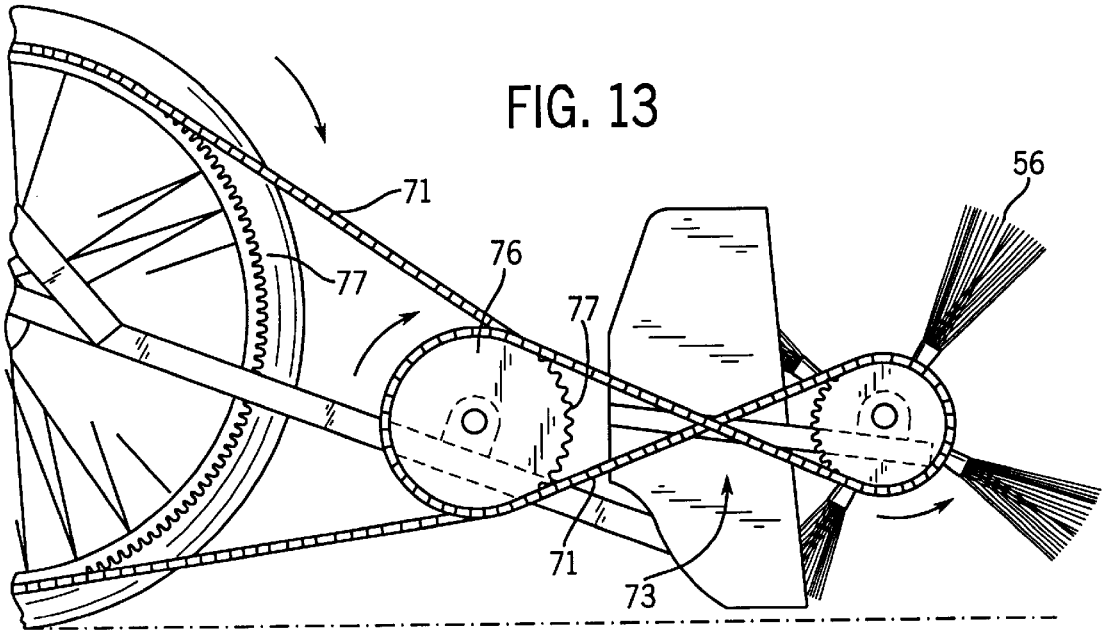
FIG. 13 shows an alternate embodiment of the drive mechanism using sprockets and a chain, as well as an alternate embodiment of the throwing mechanism employing brushes.
Figure 14:
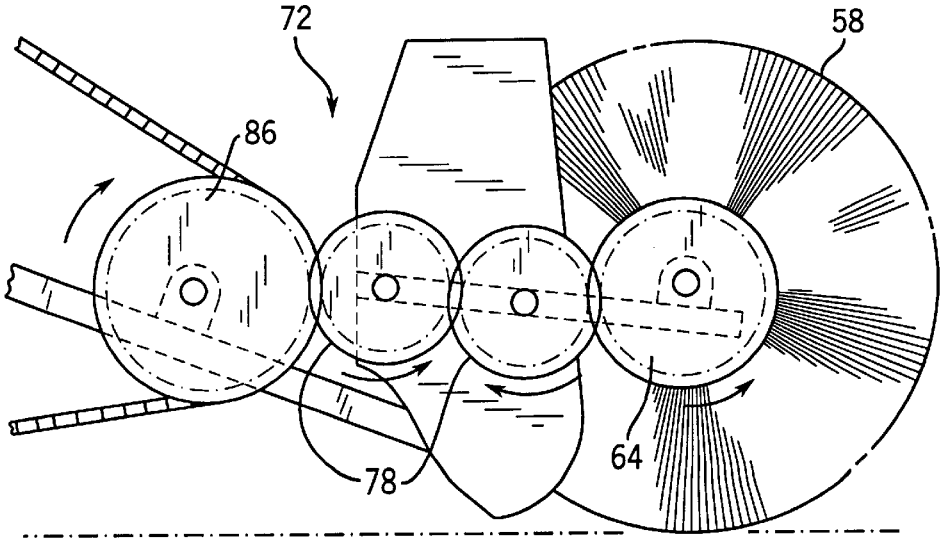
FIG. 14 shows an alternate embodiment of the drive mechanism using gears, as well as an alternate embodiment of the throwing mechanism employing a plurality of bristles.

As shown in FIG. 4, the throwing mechanism 40 comprises a primary drive shaft 42 journaled in bearings 43 seated in a pair of laterally spaced uprights 44 secured to the frame 22. Coupled to the primary drive shaft 42 is at least one scraper blade 50. The preferred embodiment includes four scoop-shaped scraper blades 50 coupled to the primary drive shaft 42 at approximately equidistant intervals. The blades 50 may be scoop-shaped 52 as depicted in FIGS. 1, 6 and 7. The blades 50 may be made of metal such as steel or aluminum, plastic, rubber, natural or synthetic bristles or other material suitable for removal of a specific type of debris. For example, although a steel blade is most suitable for hard snow and ice, a rubber blade may be most suitable for pushing away slush or water. For wet snow a metal blade with a non-stick coating 54, such as Teflon, is most practical. For added strength, especially if plastic is used, the blade may contain vertical ribbing or beading (not shown.) To remove light snow, the blade may comprise multiple bristles configured to form at least one brush 56, as shown in FIG. 13. An alternate brush configuration 58 is illustrated in FIG. 14. A brush 56 or 58 not only permits easy removal of light snow, but also allows the machine to sweep away dirt and other debris. Utilizing a brush 56 or 58 to sweep away dirt will extend the machine's usefulness to any season. Consequently, by designing the machine to utilize a brush 56 or 58 the machine may be used in warmer climates that do not experience snowfall.

As further depicted in FIG. 1, the preferred embodiment includes a partial enclosure or shroud 30 attached to the frame 22. The shroud 30 includes a conforming portion 34 that partially surrounds the throwing mechanism 50. The shroud 30 may also contain a runner portion 32 to scrape up ice, snow, dirt, or other debris. The conforming portion 34 is radially spaced from the throwing mechanism 40 so as to conform to the throwing mechanism's 40 path 48. The shroud 30 can be made of steel, aluminum, plastic, rubber, or any other material sufficiently strong to guide the debris and protect the operator from misdirected material. If a heavier gage material is used to construct portions of the shroud 30, theses portions may act as part of the frame 22 in supporting the throwing mechanism 40 or portions of the drive mechanism 60.

The runner portion 32 of the shroud 30 may be made of hard steel for wear qualities or otherwise reinforced to withstand the harsh wear of scraping against the ground. The runner portion 32 is secured to the free end lip 35 of the conforming portion 34 of the shroud 30 and may be removable so that the runner portion 32 can be easily replaced once it is worn. Because a runner portion 32 may not be practical in an alternate embodiment that utilizes brushes 56 or 58, an easily removed runner portion 32 would facilitate switching between a scoop-shaped 52 blade 50 and a brush 56 or 58.

As shown in FIGS. 2 and 7, the drive mechanism 60 includes a drive wheel 62, a driven wheel 64, and a means of mechanically connecting the drive wheel 62 and the driven wheel 64. The means of mechanically connecting the drive wheel 62 and the driven wheel 64 may include at least one belt 70, at least one chain 71, a series of interlocking gears 72, or a combination of these mechanical devices. Care must be taken to arrange the belt 70, chain 71, gears 72, or other means so that the throwing mechanism rotates in a direction that would throw the snow or debris forward. This may include twisting a belt 70 or chain 71 into a figure-eight configuration 73 as shown in FIGS. 7 and 8.

For the best results, the throwing mechanism 40 must rotate quite rapidly. Consequently, the drive wheel 62 must be larger than the driven wheel 64. As seen in FIG. 7, in the preferred embodiment the drive wheel 62 is substantially larger than the driven wheel 64.

Figure 8:
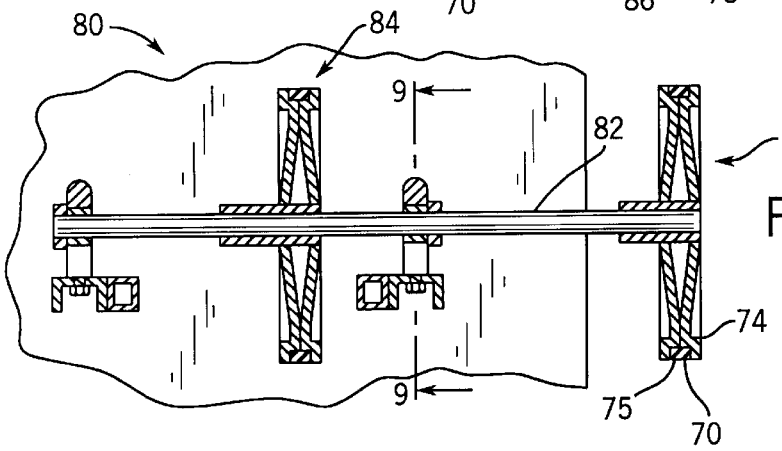
FIG. 8 is a cross sectional view of the intermediate drive mechanism taken along lines 8—8 of FIG. 7.

The preferred embodiment of the drive mechanism 60 further includes an intermediate drive mechanism 80, best shown in FIGS. 2 and 8. The intermediate drive mechanism 80 includes an intermediate drive shaft 82 rotatably coupled to the frame 22, a first wheel 84, and a second wheel 86. The first wheel 84 and the second wheel 86 are attached near opposing ends of the intermediate drive shaft 82. In this preferred embodiment, the drive wheel 62 is mechanically connected to the first wheel 84, and the second wheel 86 is mechanically connected to the driven wheel 64.

The means of mechanically connecting the drive wheel 62 to the first wheel 84, or the second wheel 86 to the driven wheel 64 can include a belt 70, a chain 71, or other comparable means. If a belt 70 is used, the drive wheel 62, first wheel 84, second wheel 86, or driven wheel 64 would each need to include a channel 75, such as a pulley 74, to support the belt 70. If a chain 71 is used, the drive wheel 62, first wheel 84, second wheel 86, or driven wheel 64 would need to include teeth 77, such as a sprocket 76, to support and grip the chain 71. A further embodiment uses a corrugated belt (not shown) in conjunction with a grooved pulley (not shown) to reduce slip.

If a series of gears 72 is used, the second wheel 86, the driven wheel 64, and any intermediate gears 78 would need to have teeth to grip one another. Furthermore, to keep the primary drive shaft 42 rotating in the proper direction to throw the snow or debris forward, an even number of gears must be placed between the second wheel 86 and the driven wheel 64.

The non-motorized machine 20 as illustrated is of relatively light weight construction and is intended to be manually pushed forward by the operator. However, if it is desired, the machine could readily be designed to be power operated or be pushed by a motorized vehicle such as an automobile, snowmobile, motorcycle, or all terrain vehicle.

A pivoting mechanism 100, as shown in FIG. 3, is the preferred method of directing the thrown material. The pivoting mechanism 100 includes a housing 102 attached to the frame 22. If a heavier gage material is used to construct portions of the shroud 30, theses portions may act as part of the frame 22 in supporting the housing 102. Within the housing 102 fits an adjustable shaft 104 such that the adjustable shaft 104 can slide back and forth through the housing 102. Referring to FIG. 4 it can be seen that the primary drive shaft 42 is journaled in bearings 43 seated in a pair of laterally spaced uprights 44 secured to the adjustment shaft 104 via a pivoting joint 120 near the second end 46 of the primary drive shaft 42. The first end 45 of the primary drive shaft 42 is journaled in bearings 43 seated in a pair of laterally spaced uprights 44 secured to the frame 22. A universal joint 122 is placed along the primary drive shaft 42 to enable the primary drive shaft 42 to rotate after it is pivoted.

Figure 10:
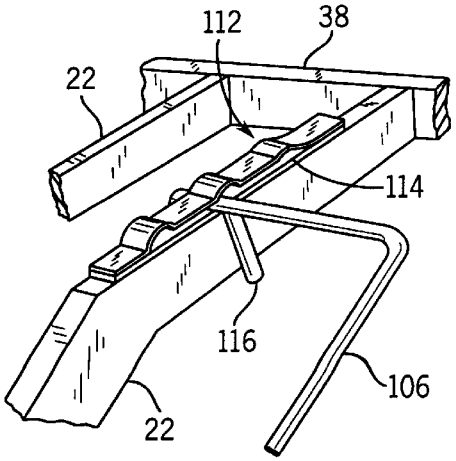
FIG. 10 is a perspective view of one embodiment of the pivot lock mechanism.

The pivoting mechanism 100 further comprises an adjustment lever 106 whose second end 110 is coupled to the adjustable shaft 104 and whose first end 108 is slidably connected to a pivot lock mechanism 112 located on the handle member 38. As shown in FIG. 10, the pivot lock mechanism 112 includes at least one aperture 114 to lock the pivot mechanism 100 in place by sliding the first end 108 of the adjustment lever 106 into an aperture 112. A guide bar 116 may be connected to the adjustment lever 106 to help guide the adjustment lever 106 into the desired aperture 114.

As shown in FIG. 3, an operator can apply pressure to the adjustment lever 106 thereby moving the adjustable shaft 104 to slide through the housing 102 and push the second end 46 of the throwing mechanism 40 forward. The pivoting joint 120 works in conjunction with the universal joint 122 to allow the blade 50 to pivot yet still allow the throwing mechanism 40 to rotate. The throwing mechanism 40 is locked into a pivoted position by placing the first end 108 of the adjustment lever 106 into an aperture 114, which prohibits the pivot mechanism 100 from further movement. By a like process, pulling on the adjustment lever 106 will pivot the throwing mechanism 40 in the opposite direction.

Figure 11:
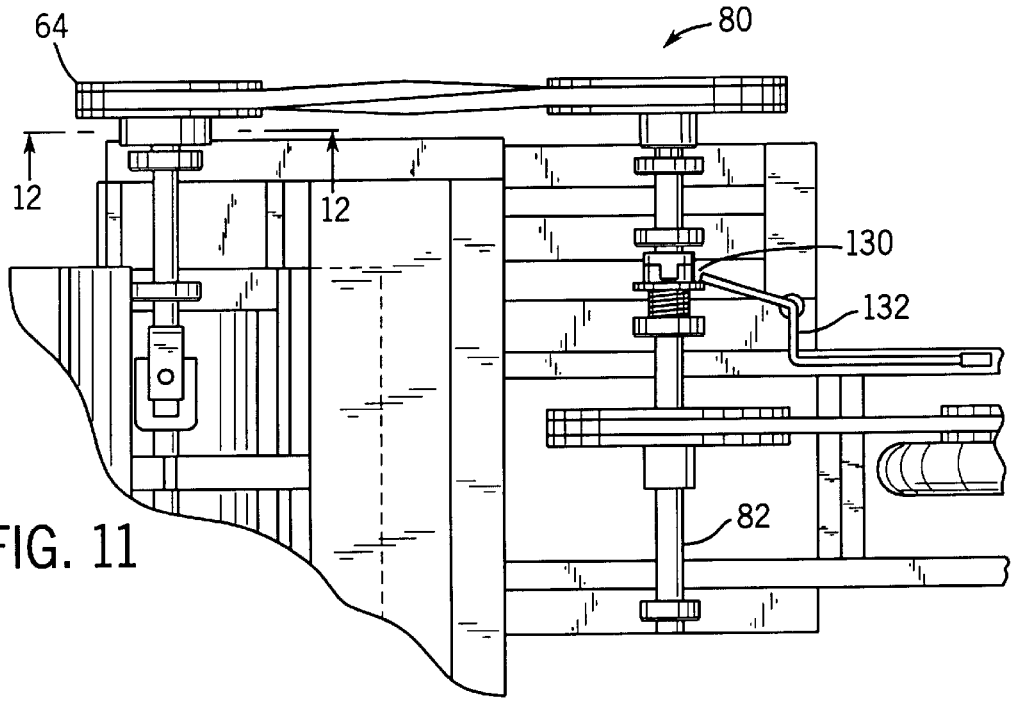
FIG. 11 shows an alternate embodiment of the machine employing a disengaging clutch.

FIG. 11 shows the drive mechanism 60 further including a disengaging clutch 130. Although a disengaging clutch 130 could be placed any where along the drive mechanism 60, in the preferred embodiment the disengaging clutch 130 is placed along the intermediate drive shaft 82 of the intermediate drive mechanism 80. The disengaging clutch allows the machine's 20 operator to disengage the drive mechanism 60 so that the throwing mechanism 40 will not rotate when the support wheel 21 rotates. To reduce wear and increase safety, the disengaging clutch 130 allows an operator to push the machine 20 to a job site without having the throwing mechanism 40 rotate. To allow easy manipulation of the disengaging clutch 130, an adjustment lever 132 is provided.

Figure 12:
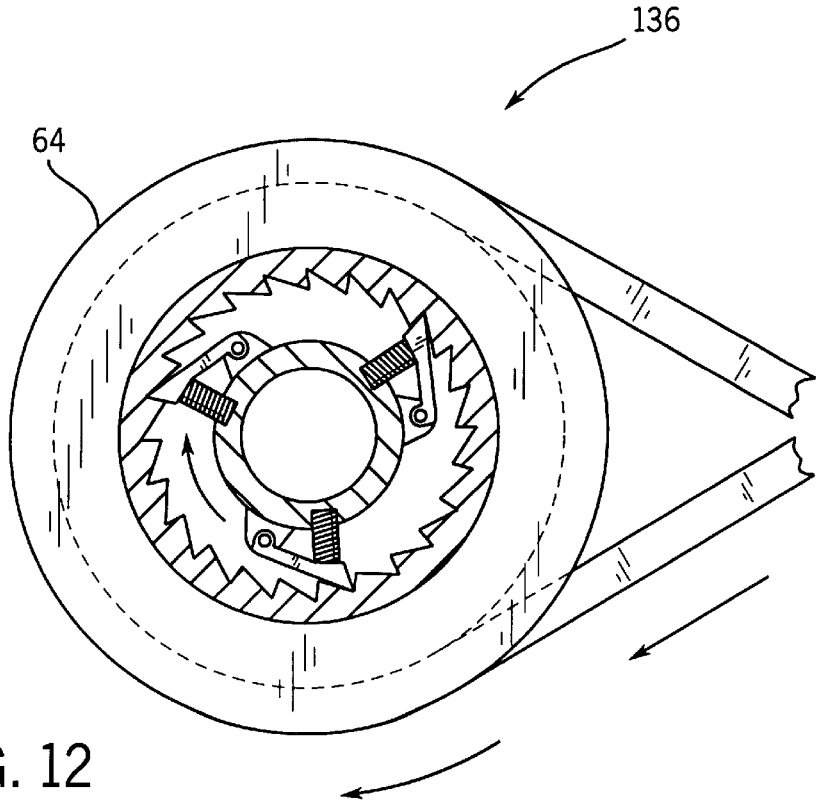
FIG. 12 shows an alternate embodiment of the machine employing a ratcheting freewheel.

The machine 20 may further include a ratcheting freewheel 136, FIG. 12, that transmits torque in only one direction. The freewheel 136 is implemented to disengage the throwing mechanism 40 when the machine 20 is moved in reverse. Although in the preferred embodiment the driven wheel 64 houses the freewheel 136, the freewheel 136 may be incorporated into any part of the drive mechanism 60 including the drive wheel 62, the first wheel 84, the second wheel 86, or the disengaging clutch 130.

Figure 9:
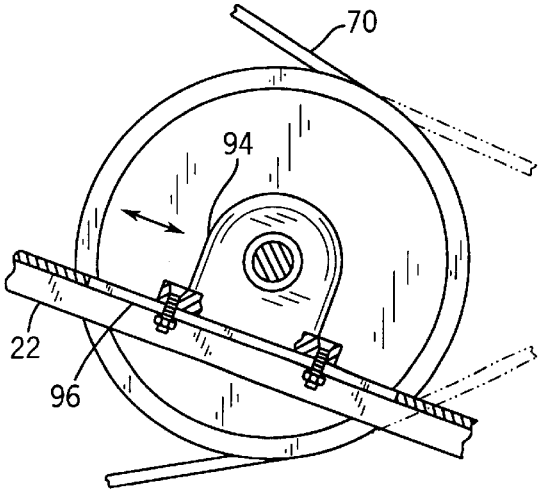
FIG. 9 is a cross sectional view of one embodiment of the intermediate drive mechanism taken along lines 9—9 of FIG. 8.

FIG. 9 depicts the ability to adjust the belt 70 or chain 71 tension by sliding the bearing block 94 along an elongated opening 96 in the frame 22. FIG. 7 depicts a similar mechanism whereby one may adjust the belt 70 or chain 71 tension by sliding the support wheel 21 along an elongated opening 98 in the frame 22. FIG. 6 depicts a similar mechanism whereby one may adjust the belt 70 or chain 71 tension by sliding the throwing mechanism 40 along an elongated opening 97 in the frame 22.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. A non-motorized machine for throwing debris comprising:

a frame;

at least one support wheel rotatably coupled to said frame;

a handle member attached to said frame;

a throwing mechanism rotatably coupled to said frame, said throwing mechanism including at least one blade and a primary drive shaft, said blade being attached to said primary drive shaft;

a shroud attached to said frame and at least partially surrounding said throwing mechanism;

a drive mechanism interposed between and mechanically connecting said support wheel and said throwing mechanism;

a pivoting mechanism for pivoting said throwing mechanism;

said pivoting mechanism being attached to said frame;

said pivoting mechanism including a housing attached to said frame; an adjustment shaft slidably contained within said housing; a pivoting joint rotatably connecting said debris throwing mechanism to said adjustment shaft; and a universal joint coupled to said primary drive shaft.

2. A non-motorized machine for throwing debris comprising:

a frame;

at least one support wheel rotatably coupled to said frame;

a handle member attached to said frame;

throwing mechanism rotatably coupled to said frame, said throwing mechanism including at least one blade and a primary drive shaft, said blade being attached to said primary drive shaft;

a shroud attached to said frame and at least partially surrounding said throwing mechanism;

a drive mechanism interposed between and mechanically connecting said support wheel and said throwing mechanism;

a pivoting mechanism for pivoting said throwing mechanism;

said pivoting mechanism being attached to said frame;

said pivoting mechanism including a pivot lock member attached to said frame, said pivot lock member including a plurality of apertures; a housing attached to said frame; an adjustment shaft slidably contained within said housing; an adjustment lever having a first end and a second end, said first end connected to said adjustment shaft, and said second end slidably attached to said pivot lock member; a pivoting joint connecting said blade mechanism to said adjustment shaft; and a universal joint coupled to said primary drive shaft.

3. A method of pivotally supporting a rotating mechanism on a machine for throwing debris, wherein said rotating mechanism includes a first end, a second end, and a primary drive shaft, said method comprising:

providing a frame;

rotatably coupling said second end of said rotating mechanism to said frame;

providing a housing attached to said frame;

providing an adjustment shaft slidably contained within said housing;

providing a pivoting joint rotatably connecting said first end of said rotating mechanism to said adjustment shaft; and providing a universal joint coupled to said primary drive shaft near said second end of said rotating mechanism.

4. A pivoting mechanism for a machine for throwing debris, said machine including a frame and a rotating mechanism, said rotating mechanism including a first end rotatably coupled to said frame, a second end, and a primary drive shaft, said pivoting mechanism comprising:

a pivot lock member attached to said frame, said pivot lock member including a plurality of apertures;

a housing attached to said frame;

an adjustment shaft slidably contained within said housing;

an adjustment lever having a first end and a second end, said first end connected to said adjustment shaft, and said second end slidably attached to said pivot lock member;

a pivoting joint rotatably connecting said second end of said rotating mechanism to said adjustment shaft; and a universal joint coupled to said primary drive shaft near said first end of said rotating mechanism.

* * * * *